US007549618B1

(12) United States Patent
Scott

(10) Patent No.: US 7,549,618 B1
(45) **Date of Patent: *Jun. 23, 2009**

(54) STRAIGHT BORE BUTTERFLY VALVE CARBURETOR WITH ACCELERATOR ASSIST MODULE

(75) Inventor: William A. Scott, Summit Lake, WI (US)

(73) Assignee: Country Industries Technologies, LLC, Summit Lake, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/243,240

(22) Filed: Oct. 1, 2008

(51) Int. Cl.
*F02M 7/093* (2006.01)

(52) U.S. Cl. ..... 261/34.2; 261/35

(58) Field of Classification Search ..... 261/34.2, 261/35, DIG. 68

See application file for complete search history.

(56) References Cited

U.S. PATENT DOCUMENTS 2,926,892 A * 3/1960 Wentworth ..... 261/34.2
5,843,345 A * 12/1998 Guntly ..... 261/34.2
6,481,699 B1 11/2002 Aihara et al.
6,631,889 B2 * 10/2003 Nonaka ..... 261/35
7,143,999 B2 * 12/2006 Ogishi ..... 261/34.2
7,172,178 B1 * 2/2007 Hacker ..... 261/34.2
7,410,153 B1 8/2008 Scott
2003/0168752 A1 * 9/2003 Nonaka ..... 261/35
2004/0232569 A1 * 11/2004 Nonaka ..... 261/35

FOREIGN PATENT DOCUMENTS

DE 3219720 C1 * 12/1983 ..... 261/34.2

* cited by examiner

*Primary Examiner*—Richard L Chiesa
(74) *Attorney, Agent, or Firm*—Donald J. Ersler

(57) ABSTRACT

A straight bore butterfly valve carburetor with accelerator assist module includes a butterfly valve carburetor with a straight bore and a vacuum accelerator assist module. The butterfly valve carburetor with a straight bore includes a substantially straight bore intake chamber. The venturi in the intake chamber is eliminated. The vacuum accelerator assist module includes two housing halves, a diaphragm and means for biasing the diaphragm into the fuel chamber. The diaphragm creates a vacuum chamber and a fuel chamber. The vacuum chamber communicates with the substantially straight bore intake chamber and the fuel chamber communicates with a fuel metering chamber of the carburetor. A vacuum is applied to the diaphragm at engine idle, which overcomes the means for biasing. When the butterfly valve is opened, the vacuum collapses and fuel is feed into the substantially straight bore intake chamber to increase engine speed.

20 Claims, 3 Drawing Sheets

STRAIGHT BORE BUTTERFLY VALVE CARBURETOR WITH ACCELERATOR ASSIST MODULE

BACKGROUND OF THE INVENTION

1. Field of the Invention

The present invention relates generally to carburetors and more specifically to a straight bore butterfly valve carburetor with accelerator assist module, which enables a butterfly valve to be used for small engine applications without the problem of reverse flow.

2. Discussion of the Prior Art

Butterfly valve carburetors running on a lean fuel mixture cannot accelerate without a venturi intake chamber. However, intake chambers with a venturi exaggerate the problem of reverse flow or spit back by increasing the velocity of the reverse flow. Reverse flow occurs every time the engine makes a revolution. Gas is forced back through the intake manifold, intake chamber and into the air cleaner every time the engine makes a revolution. The present solution to the reverse flow problem is to replace the butterfly valve with a rotary valve or a sliding valve. Replacing the venturi intake chamber with a substantially straight bore intake chamber decreases the velocity of the reverse flow and greatly decreases the amount of gas forced back into the air cleaner.

Using an acceleration assist module as disclosed in U.S. Pat. No. 7,410,153 is hereby incorporated by reference in its entirety and has the unexpected result or benefit of allowing the venturi to be completely eliminated from the intake chamber of the carburetor. Further, elimination of the venturi has the unexpected result of allowing the use of a dependent fuel supply system. Fuel adjustment needles in the dependent fuel supply system are replaced with fixed jets. Fuel flows through a fixed size aperture in the fixed jet and cannot be adjusted, because the adjustment needle is eliminated. Fixed jets are well known in the art and need not be explained in further detail.

Using fixed jets instead of adjustment screws lowers the cost of the carburetor and work for an engine manufacturer. A carburetor manufacturer collects data concerning a specific engine and fine tunes the fixed jets for the specific engine. The carburetor is fastened to the specific engine without the need for manipulating adjustment needles.

U.S. Pat. No. 6,481,699 to Aihara et al. discloses an acceleration device for a two-cycle engine. The Aihara et al. patent includes an acceleration device of a carburetor for a two cycle engine with a rotary valve, which controls air flow through both a scavenging passage and a separate air intake passage each extending through a carburetor body. However, the acceleration device is connected to an air reference chamber located below a metering fuel chamber. The air reference chamber is separated from the metering fuel chamber by a diaphragm.

Accordingly, there is a clearly felt need in the art for a straight bore butterfly valve carburetor with accelerator assist module, which enables a butterfly valve without a venturi intake chamber to be used for small engine applications.

SUMMARY OF THE INVENTION

The present invention provides a straight bore butterfly valve carburetor with accelerator assist module, which enables a butterfly valve to be used for small engine applications without the problem of reverse flow. The straight bore butterfly valve carburetor with accelerator assist module (straight bore carburetor with assist module) includes a butterfly valve carburetor with a straight bore and a vacuum accelerator assist module. The butterfly valve carburetor with a straight bore includes a substantially straight bore intake chamber. The venturi in the intake chamber is eliminated.

The vacuum accelerator assist module includes two housing halves, a diaphragm and means for biasing the diaphragm. Each housing half includes a peripheral flange, a cavity and a pipe extension. The pipe extension extends from a rear of the housing half and an inner perimeter of the pipe extension communicates with the cavity. The peripheral flange extends from the outside perimeter of an open end of the housing half. The means for biasing the diaphragm is preferably a compression spring. A spring bore is formed in a bottom of the cavity, concentric with the inner perimeter of the pipe extension. The spring bore is sized to receive an outer perimeter of the compression spring. A spring retainer includes a base and a spring pin extending from the base. The spring pin is sized to receive an inner perimeter of the compression spring. A bottom of the base may be secured to the diaphragm with any suitable attachment method. However, attachment of the base to the diaphragm is optional. A perimeter of the diaphragm is retained between the peripheral flanges of the two housing halves. The peripheral flange of each housing half preferably includes means for securing thereof to the opposing peripheral flange.

The diaphragm creates a vacuum chamber and a fuel chamber in the accelerator module. The vacuum chamber communicates with an intake chamber of a carburetor through a vacuum tube. A fuel chamber communicates with a fuel metering chamber of the carburetor through a fuel tube. At idle, the butterfly valve is closed, which creates a vacuum in the vacuum chamber on an engine side of the butterfly valve. The vacuum is sufficient to overcome spring pressure of the compression spring and pulls the diaphragm toward a bottom of the vacuum chamber. When the butterfly valve is opened, the vacuum collapses and air inside the fuel cavity is displaced into the fuel metering chamber of the carburetor. The air pressure pushes extra fuel out of the fuel metering chamber into the intake chamber to increase engine speed. During engine revolution, the substantially straight bore intake chamber does not increase the velocity of the reverse flow as a venturi intake chamber does.

Accordingly, it is an object of the present invention to provide a straight bore carburetor with accelerator assist module, which works with either two cycle or four cycle internal combustion engines.

It is a further object of the present invention to provide a straight bore carburetor with accelerator assist module, which connects directly to a fuel metering chamber and does not require an extra diaphragm.

It is yet a further object of the present invention to provide a straight bore carburetor with accelerator assist module, which includes an intake chamber without a venturi.

Finally, it is another object of the present invention to provide a straight bore carburetor with accelerator assist module, which costs less to implement than the prior art.

These and additional objects, advantages, features and benefits of the present invention will become apparent from the following specification.

DETAILED DESCRIPTION OF THE PREFERRED EMBODIMENTS

Figure 1:
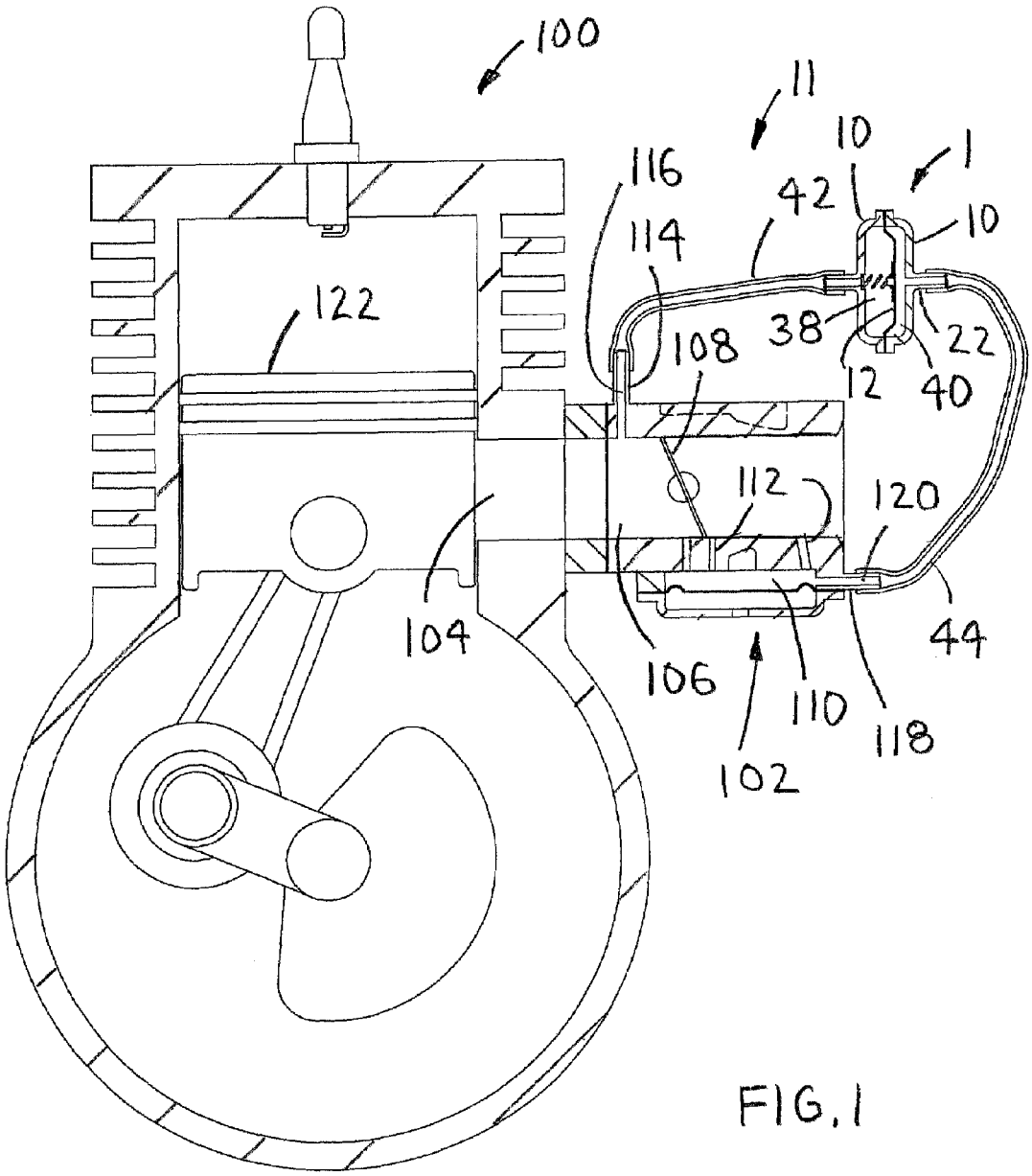
FIG. 1 is a cross sectional view of an accelerator module, a carburetor and an internal combustion engine not operating in accordance with the present invention.

With reference now to the drawings, and particularly to FIG. 1, there is shown a straight bore carburetor with assist module 11. The straight bore carburetor with assist module 1 includes a butterfly valve carburetor with a straight bore (carburetor) 102 and a vacuum accelerator assist module (accelerator module) 1. The carburetor 102 includes a substantially straight bore intake chamber 106. The venturi normally located at the entrance of the intake chamber is eliminated.

With reference to FIGS. 1-4, the accelerator module 1 includes two housing halves 10, a diaphragm 12 and means for biasing the diaphragm 12. Each housing half 10 includes a peripheral flange 18, a cavity 20 and a pipe extension 22. The pipe extension 22 extends from a rear of the housing half 10 and an inner perimeter 24 of the pipe extension 22 communicates with the cavity 20. The peripheral flange 18 extends from the outside perimeter of an open end of the housing half 10. The means for biasing the diaphragm 12 is preferably a compression spring 14. A spring bore 26 is formed in a bottom of the cavity 20, concentric with the inner perimeter 24 of the pipe extension 22. The spring bore 26 is sized to receive an outer perimeter of the compression spring 14.

A spring retainer 28 includes a base 30 and a spring pin 32. The spring pin 32 extends outward from the base 30. The spring pin 32 is sized to receive an inner perimeter of the compression spring 14. A bottom of the base 30 may be secured to the diaphragm 12 with any suitable attachment method, such as adhesive. However, attachment of the base 30 to the diaphragm 12 is optional. The peripheral flange 18 of each housing half 10 preferably includes a plurality of integral snap clips 34 extending therefrom and a plurality of snap cavities 36 formed therein for attaching the two housing halves 10 to each other and retaining the diaphragm 12. Ends of the plurality of snap clips 34 are received by the plurality of snap cavities 36. The plurality of snap clips 34 with the diaphragm 12 create an air and liquid tight seal between the cavities 20 and the atmosphere. It is also preferable to sonic weld the two flanges to each other to ensure the air and liquid seal. One method of attaching the two housing halves 10 is shown, but other suitable attachment methods may also be used. The diaphragm 12 creates a vacuum chamber 38 and a fuel chamber 40 in the two housing halves 10.

The carburetor 102 is attached to an internal combustion engine 100, adjacent an intake port 104. The carburetor 102 includes the substantially straight bore intake chamber 106, a butterfly valve 108 and a fuel metering chamber 110. The butterfly valve 108 is pivotally retained in the substantially straight bore intake chamber 106. The fuel metering chamber 110 is located below the substantially straight bore intake chamber 106. The fuel metering chamber 110 communicates with the substantially straight bore intake chamber 106 through at least one fuel passage 112. A vacuum pipe 114 extends from a top of the carburetor 102 and a vacuum port 116 is formed from the substantially straight bore intake chamber 106 into the vacuum pipe 114. A fuel pipe 118 extends from a side of the carburetor 102 and a fuel port 120 is formed from the fuel metering chamber 110 into the fuel pipe 118.

One end of a vacuum tube 42 is engaged with the vacuum pipe 114 and the other end is engaged with the pipe extension 22, adjacent the vacuum chamber 38. The vacuum tube 42 provides communication between the substantially straight bore intake chamber 106 and the vacuum chamber 38. One end of a fuel tube 44 is engaged with the fuel pipe 118 and the other end is engaged with the pipe extension 22, adjacent the fuel chamber 40. The fuel tube 44 provides communication between the fuel metering chamber 110 and the fuel chamber 40.

Figure 3:
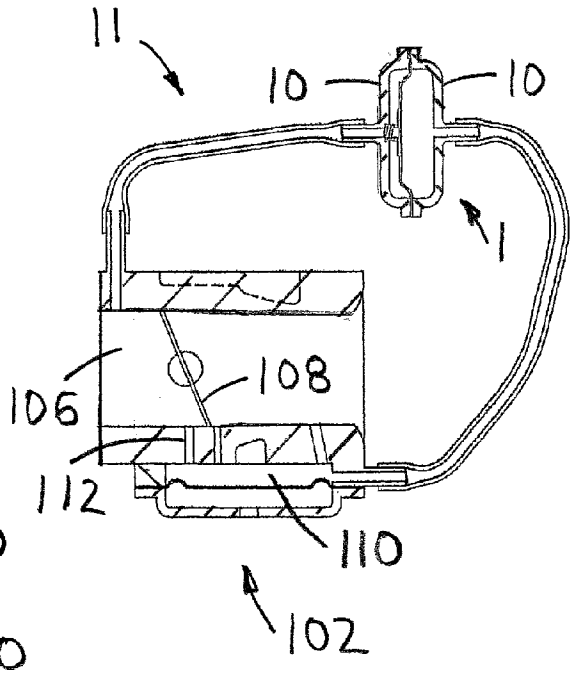
FIG. 3 is a cross sectional view of an accelerator module and a carburetor, while an internal combustion engine is idling in accordance with the present invention.
Figure 2:
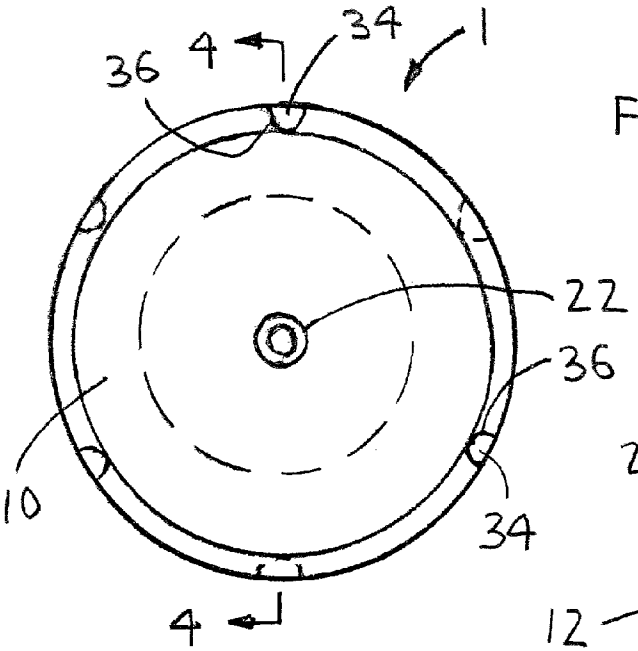
FIG. 2 is an enlarged end view of an accelerator module in accordance with the present invention.
Figure 4:
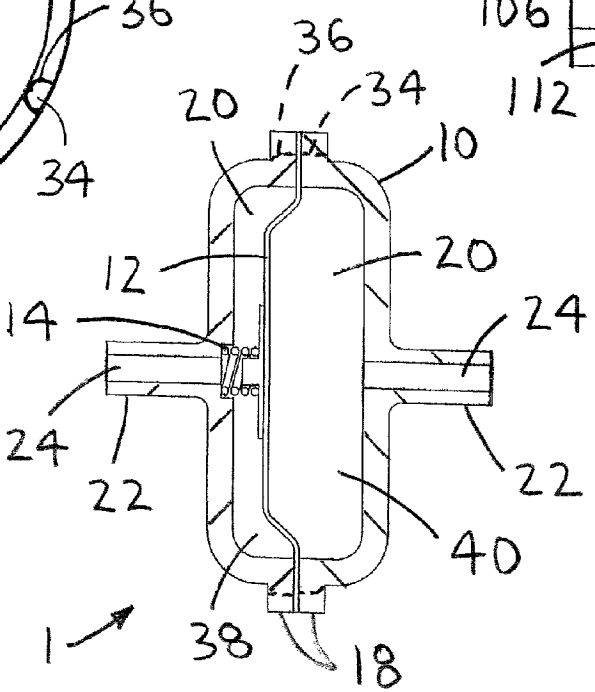
FIG. 4 is an enlarged cross sectional view of an accelerator module, while an internal combustion engine is idling in accordance with the present invention.

With reference to FIGS. 3-4, during engine idle, the butterfly valve 108 is closed. A reciprocating piston 122 pulls a vacuum on the vacuum chamber 38. The vacuum is sufficient to overcome spring pressure of the compression spring 14, which pulls the diaphragm 12 toward a bottom of the vacuum chamber 38. The acceleration module 1 may be calibrated for different carburetors and engines by changing a spring rate of the compression spring 14.

Figure 5:
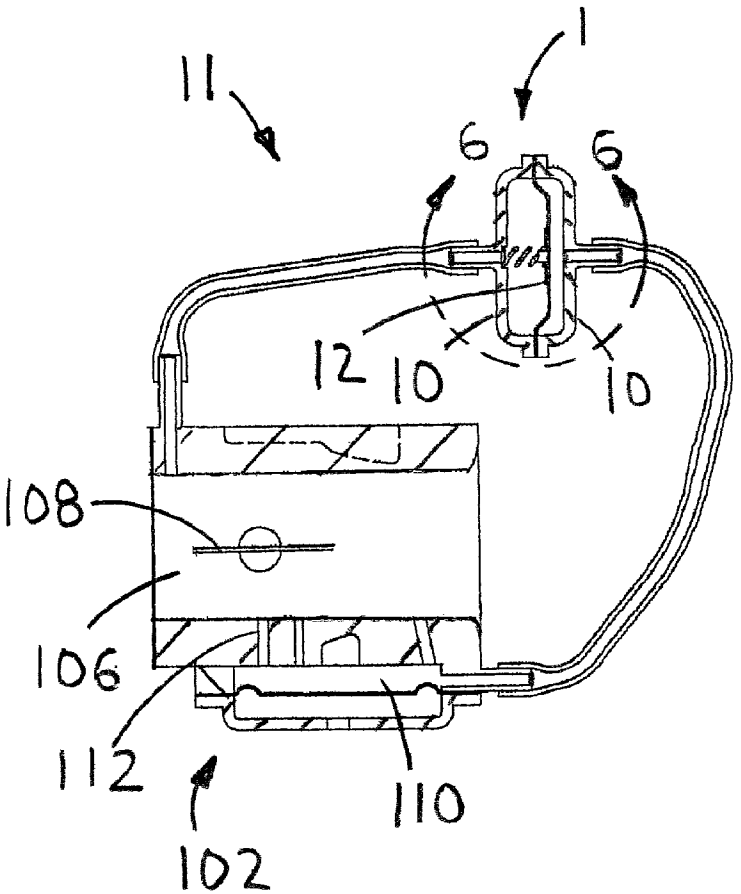
FIG. 5 is a cross sectional view of an accelerator module and a carburetor, after an internal combustion engine is throttled in accordance with the present invention.
Figure 6:
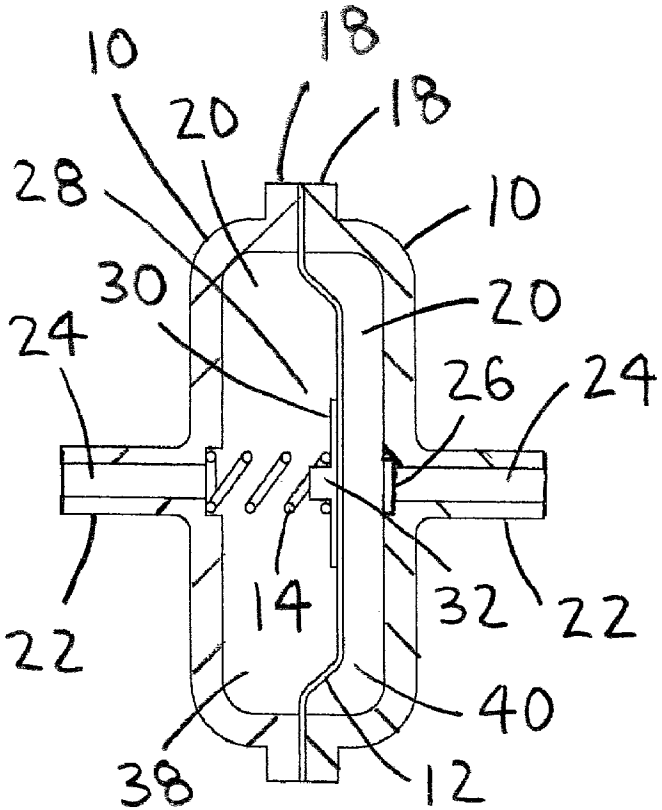
FIG. 6 is an enlarged cross sectional view of an accelerator module, after an internal combustion is throttled in accordance with the present invention.

With reference to FIGS. 5-6, when the butterfly valve 108 is opened, the vacuum in the vacuum chamber 38 collapses and air inside the fuel cavity 40 is displaced into the fuel metering chamber 110 of the carburetor 102. The air pressure pushes extra fuel out of the fuel metering chamber 110 into the substantially straight bore intake chamber 106 to increase engine speed. During engine revolution, the substantially straight bore intake chamber 106 does not increase the velocity of the reverse flow as a venturi intake chamber does. The use of the vacuum accelerator module 1 in conjunction with the butterfly valve carburetor 102 having the substantially straight bore intake chamber 106 allows fuel adjustment needles in a dependent fuel supply system to be replaced with fixed jets.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A butterfly valve carburetor having a substantially straight bore intake chamber in combination with an accelerator assist module, comprising:

a first housing half and a second housing half, each said housing half including a cavity;

a diaphragm being retained between said first and second housing halves, said diaphragm creating a first chamber and a second chamber; and means for biasing said diaphragm into said second chamber, wherein, said first chamber communicating with said substantially straight bore intake chamber of said butterfly valve carburetor, said second chamber communicating with a fuel metering chamber of said butterfly valve carburetor.

2. The butterfly valve carburetor having a substantially straight bore intake chamber in combination with an accelerator assist module of claim 1, further comprising:

a peripheral flange extending from an outside perimeter of an open end of each said housing half.

3. The butterfly valve carburetor having a substantially straight bore intake chamber in combination with an accelerator assist module of claim 2, further comprising:

means for attaching said peripheral flange of said first and second housing halves together.

4. The butterfly valve carburetor having a substantially straight bore intake chamber in combination with an accelerator assist module of claim 1, further comprising:

said butterfly valve carburetor including a dependent fuel supply system with fixed jets.

5. The butterfly valve carburetor having a substantially straight bore intake chamber in combination with an accelerator assist module of claim 1, further comprising:

a pipe extension extending from a rear of each said housing half, an inner perimeter of said pipe extension communicating with said cavity.

6. The butterfly valve carburetor having a substantially straight bore intake chamber in combination with an accelerator assist module of claim 1, wherein:

said means for biasing said diaphragm into said second chamber being a compression spring.

7. The butterfly valve carburetor having a substantially straight bore intake chamber in combination with an accelerator assist module of claim 6, further comprising:

a spring retainer being attached to said diaphragm, said spring retainer being sized to retain one end of said compression spring.

8. A butterfly valve carburetor in combination with a vacuum accelerator assist module, comprising:

said butterfly valve carburetor including a substantially straight bore intake chamber and a fuel metering chamber;

said vacuum accelerator assist module including a diaphragm disposed inside a cavity; and a first chamber being created on one side of said diaphragm and a second chamber being created on the other side of said diaphragm, wherein said first chamber communicating with said substantially straight bore intake chamber, said second chamber communicating with said fuel metering chamber.

9. The butterfly valve carburetor in combination with a vacuum accelerator assist module of claim 8, further comprising:

means for biasing said diaphragm into one of said first and second chambers.

10. The butterfly valve carburetor in combination with a vacuum accelerator assist module of claim 8, further comprising:

said cavity being created inside a first housing half and a second housing half.

11. The butterfly valve carburetor in combination with a vacuum accelerator assist module of claim 10, further comprising:

means for attaching said first and second housing halves together.

12. The butterfly valve carburetor in combination with a vacuum accelerator assist module of claim 11, further comprising:

said means for attaching said first and second housing halves together being a plurality of snap clips and snap cavities.

13. The butterfly valve carburetor in combination with a vacuum accelerator assist module of claim 10, further comprising:

a pipe extension extending from a rear of each said housing half, an inner perimeter of said pipe extension communicating with said cavity.

14. The butterfly valve carburetor in combination with a vacuum accelerator assist module of claim 8, wherein:

said butterfly valve carburetor including a dependent fuel supply system with fixed jets.

15. A butterfly valve carburetor in combination with a vacuum accelerator assist module, comprising:

said butterfly valve carburetor including a substantially straight bore intake chamber and a fuel metering chamber;

said vacuum accelerator assist module including a diaphragm disposed inside a cavity;

a first chamber being created on one side of said diaphragm and a second chamber being created on the other side of said diaphragm; and means for biasing said diaphragm into one of said first and second chambers, wherein said first chamber communicating with said substantially straight bore intake chamber, said second chamber communicating with said fuel metering chamber.

16. The butterfly valve carburetor in combination with a vacuum accelerator assist module of claim 15, further comprising:

said cavity being created inside a first housing half and a second housing half.

17. The butterfly valve carburetor in combination with a vacuum accelerator assist module of claim 16, further comprising:

means for attaching said first and second housing halves together.

18. The butterfly valve carburetor in combination with a vacuum accelerator assist module of claim 17, further comprising:

said means for attaching said first and second housing halves together being a plurality of snap clips and snap cavities.

19. The butterfly valve carburetor in combination with a vacuum accelerator assist module of claim 16, further comprising:

a pipe extension extending from a rear of each said housing half, an inner perimeter of said pipe extension communicating with said cavity.

20. The butterfly valve carburetor in combination with a vacuum accelerator assist module of claim 15, wherein:

said butterfly valve carburetor including a dependent fuel supply system with fixed jets.

* * * * *